US010555063B2

(12) United States Patent
Shahmurad et al.

(10) Patent No.: US 10,555,063 B2
(45) Date of Patent: Feb. 4, 2020

(54) WEATHER AND WIND BUFFETING RESISTANT MICROPHONE ASSEMBLY

(71) Applicant: GM GLOBAL TECHNOLOGY OPERATIONS LLC, Detroit, MI (US)

(72) Inventors: Bassam S. Shahmurad, Rochester Hills, MI (US); Walter A. Kargus, IV, Livonia, MI (US); Stephen M. Sifton, Macomb Township, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/009,785

(22) Filed: Jun. 15, 2018

(65) Prior Publication Data

US 2019/0387297 A1 Dec. 19, 2019

(51) Int. Cl.

| | |
|---|---|
| ***H04R 1/08*** | (2006.01) |
| ***H04R 1/40*** | (2006.01) |
| ***H04R 17/02*** | (2006.01) |

(52) U.S. Cl.

CPC ..... *H04R 1/086* (2013.01); *H04R 1/406* (2013.01); *H04R 17/02* (2013.01); *H04R 2410/07* (2013.01); *H04R 2499/13* (2013.01)

(58) Field of Classification Search

CPC ..... H04R 19/005; H04R 31/00; H04R 1/021; H04R 1/04; H04R 1/222; H04R 2201/003; H04R 2307/027; H04R 31/006; H04R 9/048; H04R 9/08; H04R 1/06; H04R 17/02; H04R 17/00; H04R 1/46; H04R 25/606; H04R 1/083; H04R 1/406; H04R 2460/13; H04R 17/025; H04R 17/10; H04R 1/08; H04R 1/086; H04R 1/38;

(Continued)

(56) References Cited

U.S. PATENT DOCUMENTS 3,764,748 A * 10/1973 Branch ..... H04R 25/606 381/190

4,715,219 A 12/1987 Frederiksen (Continued)

OTHER PUBLICATIONS

Hill et al, "Development of a weatherproof windscreen for a microphone array" *Noise Control Eng. J.* 54 (3), 2006, 169-176.

(Continued)

*Primary Examiner* — Lun-See Lao

(74) *Attorney, Agent, or Firm* — Harness, Dickey & Pierce, P.L.C.

(57) ABSTRACT

A microphone assembly includes a base that includes a first surface, a second surface and a third surface. The first surface is configured to connect the base to a mounting location in an external environment. The second surface is positioned parallel to the first surface with the third surface positioned therebetween. The third surface defines a curved shape to direct air flow that contacts the third surface in a direction away from the first surface. The microphone assembly also includes a cap disposed over and separated from the base by a gap. The cap includes a domed portion that has a convex shape that curves away from the second surface of the base. The microphone assembly also includes a microphone array that includes a plurality of microphones. The microphone array is disposed within the cap and is configured to receive acoustic signals from the external environment through the gap.

14 Claims, 11 Drawing Sheets

(58) Field of Classification Search
CPC ..... H04R 1/42; H04R 2225/31; H04R 23/00; H04R 23/006; H04R 25/04; H04L 67/12; H04L 63/0272; H04L 63/08; H03C 7/02; H03C 7/022; H04B 11/00; H04B 1/3833; H04M 1/05; H04N 5/64
USPC ..... 381/92, 369, 355, 361, 150
See application file for complete search history.

(56) References Cited

U.S. PATENT DOCUMENTS

| | | | | |
|---|---|---|---|---|
| 8,536,434 | B2 * | 9/2013 | Ruffino | G10D 13/021 84/411 R |
| 8,644,525 | B2 * | 2/2014 | Bathurst | H04R 1/406 379/202.01 |
| 9,875,733 | B2 * | 1/2018 | Sanders | B32B 5/028 |
| 2007/0064925 | A1 * | 3/2007 | Suzuki | H04R 3/005 379/420.01 |
| 2011/0137209 | A1 * | 6/2011 | Lahiji | A61B 7/026 600/586 |

OTHER PUBLICATIONS

Brüel & Kjær, *Product Data: Sound Intensity Calibrator—Type 3541-A*, 2012, 8 pages.

* cited by examiner

WEATHER AND WIND BUFFETING RESISTANT MICROPHONE ASSEMBLY

INTRODUCTION

This section provides background information related to the present disclosure which is not necessarily prior art.

The present disclosure relates to a weather and wind buffeting resistant external microphone for the detection of acoustic signals.

Microphones can be used to detect various acoustic signals in an external environment. Such external microphones are exposed to weather, wind and other contaminants. To ensure reliable and accurate detection of acoustic signals, external microphones are ideally protected from such exposure. One application for external microphones is for use on an autonomous vehicle to detect acoustic signals in the external environment. The use of external microphones on autonomous vehicles presents additional challenges because air flows over and around the microphone when the vehicle is in motion. It is desirable that such external microphones on autonomous vehicles need to reliably and accurately detect acoustic signals not only when exposed to weather, wind and other contaminants but also when the external microphone is exposed to wind buffeting and air flow when the external microphone is in motion on a vehicle.

SUMMARY

This section provides a general summary of the disclosure, and is not a comprehensive disclosure of its full scope or all of its features.

In various aspects, the present disclosure provides a microphone assembly. The microphone assembly includes a base that includes a first surface, a second surface and a third surface. The first surface is configured to connect the base to a mounting location in an external environment. The second surface is positioned parallel to the first surface with the third surface positioned therebetween. The third surface defines an angled or curved shape to direct air flow that contacts the third surface in a direction away from the first surface. The microphone assembly also includes a cap disposed over and separated from the base by a gap. The cap includes a domed portion. The domed portion has a convex shape that curves away from the second surface of the base. The microphone assembly also includes a microphone array that includes a plurality of microphones. The microphone array is disposed within the cap and is configured to receive acoustic signals from the external environment through the gap.

In one aspect, the microphone assembly may further include a scrim layer connected to the cap and positioned between the microphone array and the gap. The scrim layer may be configured to minimize or prevent water or other contaminants from contacting the microphone array.

In one aspect, the microphone assembly may further include a grill connected to the cap on a side of the scrim layer opposite to the microphone array. The grill may include one or more openings configured to permit the acoustic signals to pass through the grill to the microphone array.

In one aspect, the microphone assembly may further include a membrane positioned between the microphone array and the scrim layer. The membrane may be configured to minimize or prevent water or other contaminants from contacting the microphone array.

In one aspect, the microphone assembly may further include a foam layer disposed between the membrane and the scrim layer and fixed relative to the cap.

In one aspect, the microphone assembly may further include a first pocket and a second pocket located inside the cap. The first pocket may be defined by a lower surface of the membrane and an upper surface of the foam layer, and the second pocket may be defined by a lower surface of the foam layer and an upper surface of the scrim layer.

In one aspect, the base and the cap may have a round shape. The second surface of the base may have an outer diameter that is less than an outer diameter of the cap.

In one aspect, the outer diameter of the cap may be inset from the outer diameter of the base.

In one aspect, the microphone array may include a center microphone and a plurality of surrounding microphones connected to a microphone substrate. The microphone substrate may have a round shape and be fixed inside the cap. The center microphone may be positioned at a center of the microphone substrate and the plurality of surrounding microphones may be positioned in a peripheral arrangement around the center microphone.

In one aspect, the microphone array may include a microphone substrate connected to the cap and the plurality of microphones may include at least three microphones. The at least three microphones may be mounted to a side of the microphone substrate facing an inner surface of the domed portion of the cap and the microphone substrate may include at least one aperture to permit the acoustic signals to pass from the gap through the microphone substrate to the at least three microphones.

In one aspect, the at least one aperture may include at least one aperture for each microphone of the at least three microphones.

In one aspect, the microphone assembly may further include at least one support column connecting the cap to the base wherein the gap between the cap and base has a constant vertical height.

In one aspect, a height of the gap defined between the cap and the base may be in a range of greater than or equal to about 3.5 mm to less than or equal to about 10 mm.

In one aspect, the microphone assembly may further include a gasket positioned between the microphone array and the cap. The gasket may be configured to isolate the microphone array from vibrations associated with the cap.

In one aspect, the microphone assembly may further include at least one support column connecting the cap to the base. The support column may have a hollow channel configured to hold one or more wires that extend from the microphone array to the base.

In one aspect, the microphone assembly may further include an acoustic coupler including an actuator. The acoustic coupler may be configured to be removably positioned between the cap and the base to direct predetermined acoustic pressures to each microphone of the plurality of microphones of the microphone array for calibration, validation or diagnostics of the microphone array.

In one aspect, the acoustic coupler may include a divider with a ring portion and a plurality of ribs. The ring portion may be positioned on a periphery of the acoustic coupler and the plurality of ribs may project radially inwardly from the ring portion.

In one aspect, the acoustic coupler may include a biasing member positioned on a side of the acoustic coupler opposite to the divider. The biasing member biases the divider against the cap.

In one aspect, the actuator may be a piezoelectric crystal positioned at or near a center of the acoustic coupler.

In another example, the present disclosure provides another microphone assembly for connection to an external panel of an autonomous vehicle. The microphone assembly includes a round base that includes a first surface, a second surface and a third surface. The first surface is configured to connect the base to the external panel of the autonomous vehicle. The second surface is positioned parallel to the first surface with the third surface positioned therebetween. The third surface defines an angled or curved shape to direct air flow that contacts the third surface in a direction away from the first surface. The microphone assembly also includes a round cap connected to the base by at least one support member. The cap includes a base-facing surface and a domed portion. The base-facing surface of the cap is vertically spaced apart from the second surface of the base to define a gap therebetween. The microphone assembly also includes a microphone array positioned inside a void in the cap. The microphone array includes a microphone substrate and at least three microphones. The at least three microphones are connected to the microphone substrate on a side of the microphone substrate opposite to the gap. The microphone substrate defines at least one aperture. The at least three microphones are configured to receive acoustic signals from the gap through the at least one aperture. The microphone assembly also includes a membrane that includes a porous or semi-porous material positioned over the at least one aperture of a gap-facing surface of the microphone substrate. The membrane is configured to minimize or prevent water or other contaminants from contacting the at least three microphones. The microphone assembly also includes a foam layer positioned adjacent the gap-facing surface of the microphone substrate. The foam layer is configured to reduce wind buffeting and noise directed toward the at least three microphones. The microphone assembly also includes a scrim layer positioned adjacent the foam layer on the base-facing surface of the cap to cover the void. The scrim layer is configured to minimize or prevent water or other contaminants from contacting the microphone array. The microphone assembly also includes a grill connected to the base-facing surface of the cap adjacent the scrim layer. The grill includes a border positioned adjacent the peripheral edge of the cap and a plurality of support bars extending inwardly from the border. The grill supports the scrim layer.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
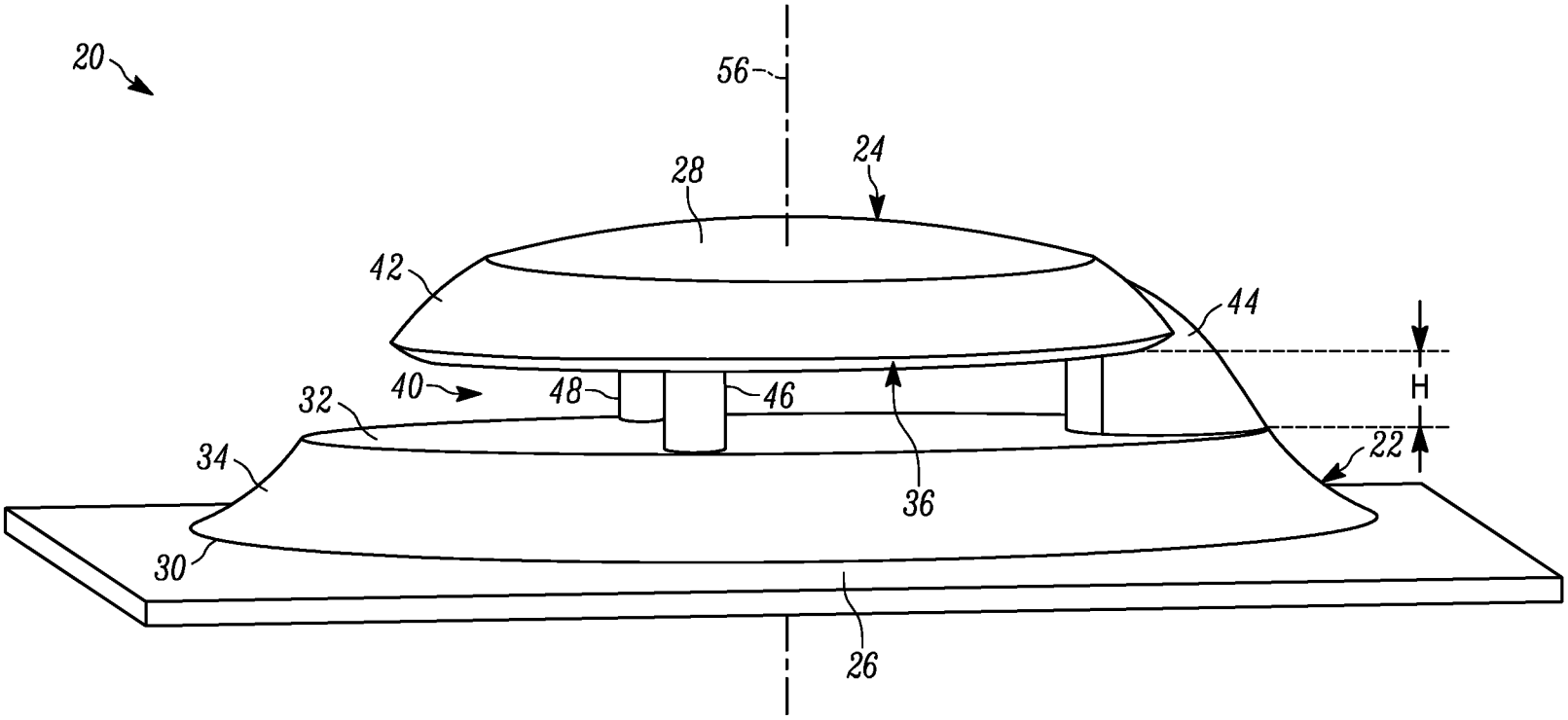
FIG. 1 is a perspective view of an example microphone assembly in accordance with the present disclosure.

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges.

Example embodiments will now be described more fully with reference to the accompanying drawings.

As shown in FIG. 1, an example microphone assembly 20 includes a base 22 and a cap 24. The microphone assembly 20, in this example, is mounted to an external panel 26 of an autonomous vehicle. The external panel 26 can be any external panel 26 of the vehicle such as a roof panel, a hood, a trunk lid, autonomous vehicle roof module, or the like. As such, the microphone assembly 20 is exposed to an external environment and therefore is potentially subjected to various contaminants from weather, wind or air that may flow over and/or contact the microphone assembly 20 when the vehicle is stationary or in motion. The microphone assembly 20 prepared in accordance with certain aspects of the present disclosure minimizes or prevents the intrusion of water or other contaminants into the microphone assembly 20. The microphone assembly 20 further minimizes or prevents wind and other noise sources from being received by the microphone assembly 20, which otherwise could potentially prevent the microphone assembly 20 from accurately and reliably capturing frequency, phase and signal-to-noise ratio information from external acoustic signals.

The microphone assemblies of the present disclosure can be mounted to exterior panels of vehicles to receive and capture acoustic signals present in an external environment. One example application of the microphone assemblies of the present disclosure is for use on autonomous vehicles. In certain aspects, it is desirable for autonomous vehicles to detect various acoustic signals during operation in order to take appropriate action. An example acoustic signal is a siren of an emergency vehicle. The detection of such a siren generated by an emergency vehicle can facilitate the autonomous vehicle taking appropriate action in response.

In certain aspects, the microphone assemblies of the present disclosure can be mounted on the external panels of autonomous vehicles to reliably and accurately detect acoustic signals present in the external environment. The microphone assemblies are robust, durable and capable of resisting exposure to weather or other contaminants, while further resisting air and/or wind buffeting to reliably and accurately detect and receive desired acoustic signals. In the various examples described below, the microphone array of the microphone assembly is inverted. In such inverted configurations, the microphone array is positioned under a cap of the microphone assembly to protect the microphone array from exposure to weather, water and other contaminants.

Figure 2:
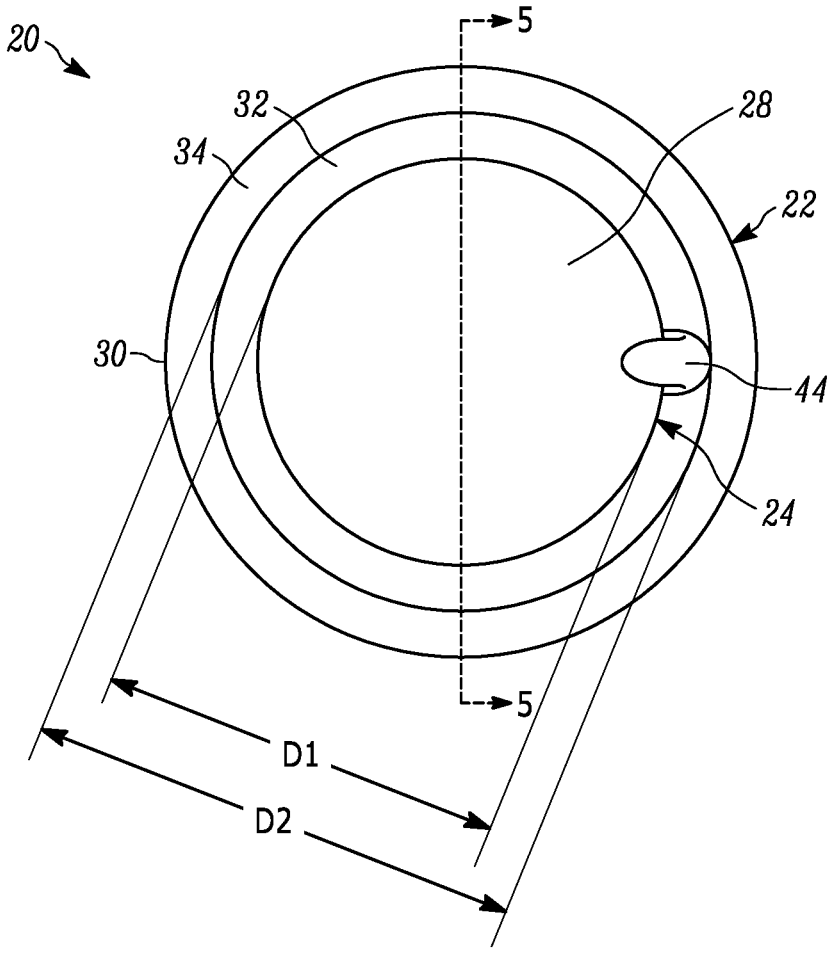
FIG. 2 is a top view of the microphone assembly of FIG. 1.

As shown in FIGS. 1 and 2, the base 22 of the microphone assembly 20, in this example, has a round outer profile when viewed from the top (see FIG. 2). In other examples, the microphone assembly 20 can have other round profiles including an oval shape, an elliptical shape, a disc shape or the like. For purposes of the present disclosure, the term round can include shapes such as oval, elliptical, spherical, hemispherical, globular, annular, toroidal, discoidal orbed, circular, semi-circular and the like. In still other examples, the microphone assembly 20 can have a wedge shape, a bullet shape, or another suitable shape.

The base 22 may include a first surface 30, a second surface 32 and a third surface 34. The first surface 30 is a planar support surface of the base 22 that is positioned adjacent to the external panel 26 when the microphone assembly 20 is attached at a mounting location. The second surface 32 is a top surface of the base 22. The second surface 32 can be a planar surface and may be oriented parallel to the first surface 30. The second surface 32, in other examples, can be curved upwardly with a convex shape relative to the first surface 30. Such an alternative convex shape can permit water or other contaminants to flow away from the second surface 30.

The third surface 34 is an outer surface of the base 22. The third surface 34 is located between the second surface 32 and the first surface 30. The third surface 34 may define a concave shape with respect to a center axis 56 of the microphone assembly 20. As shown, the third surface 34 can bow inwardly toward the center axis 56. As described further below, the third surface 34 guides air, water or other contaminants that may contact the base 22 in an upward direction or in a direction away from the base 22 or away from the first surface 30 when the microphone assembly 20 is being propelled through the air (i.e., when the microphone assembly 20 is traveling with a vehicle or on another surface to which the microphone assembly 20 may be attached). In other examples, the third surface 34 can define an angled surface or a curved surface to direct and air flow that contacts the third surface 34 in a direction away from the first surface 30.

As further shown, the cap 24 may also be round in shape. The cap 24 includes a downwardly-facing (or base-facing) surface 36 and a domed portion 28. The downwardly-facing surface 36 is a portion of the cap 24 that may be oriented parallel to the second surface 32 and therefore faces downwardly toward the external panel 26 to which the microphone assembly 20 is attached. In the example shown, the downwardly-facing surface 36 of the cap 24 is vertically spaced above the second surface 32 to define a gap 40. The gap 40 may have a constant vertical height H.

The cap 24 can be sized relative to the base 22 such that the cap is inset from the base 22. As shown in FIG. 2, the cap 24 at the downwardly-facing surface 36 has an outer diameter of D1. The base 22 at the second surface 32 has an outer diameter of D2. The outer diameter D1 of the cap 24 is smaller than the outer diameter D2 of the base 22. In this manner, the cap 24 is inset (or radially offset) from the base 22. In this configuration and with the gap 40, the microphone assembly 20 minimizes or prevents air (or wind) from flowing into the gap 40.

Figure 3:
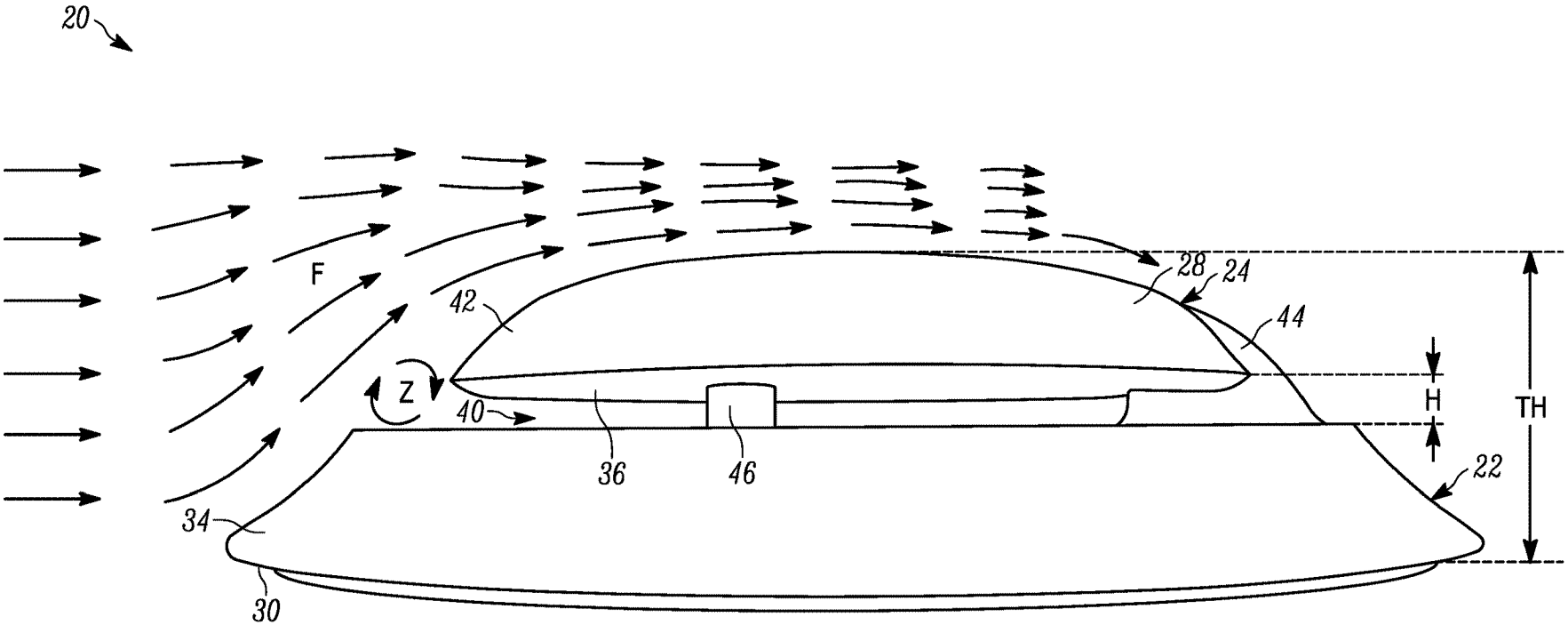
FIG. 3 is a side view of the microphone assembly of FIG. 1 illustrating an air flow over the microphone assembly.
Figure 4:
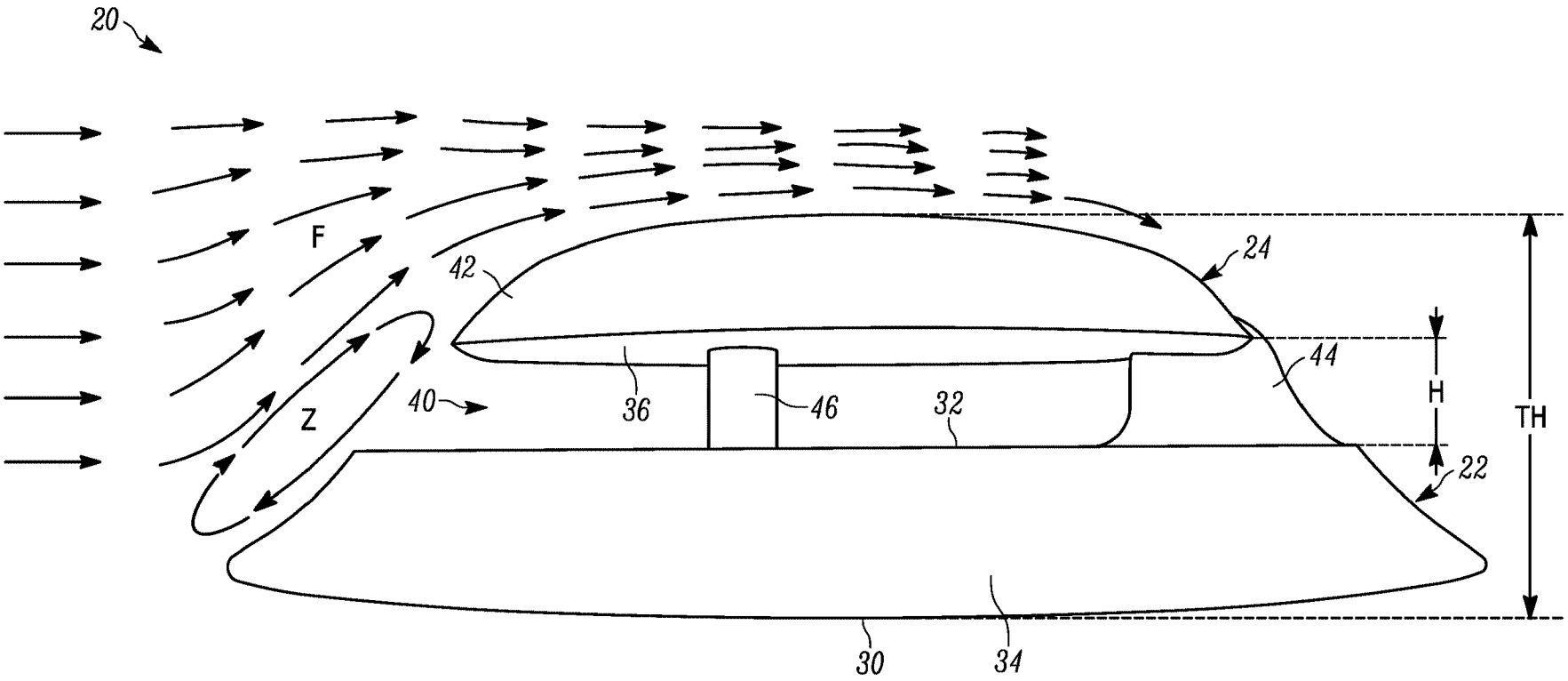
FIG. 4 is another side view of the microphone assembly of FIG. 1 illustrating an air flow over the microphone assembly in which the vertical height of the gap is larger than as shown in FIG. 3.

As shown in FIGS. 3 and 4, the shape of the base 22, the shape of the cap 24 and the height H of the gap 40 is sized so as to induce an air flow F that travels over the microphone assembly 20 to slow and recirculate in a recirculation zone Z at the leading side 42 of the cap 24. As shown, the air flow F may also be guided upwards by the base 22. The air flow F can re-attach to the domed portion 28 of the cap 24 as the air flow F moves over the microphone assembly 20. The height H of the gap may cause the air flow F to either recirculate in the recirculation zone Z and/or to flow over the gap 40 and over the cap 24. In either flow path, the air flow F is minimized or prevented from flowing through the gap 40. In this manner, microphone assembly 20 can more reliably and accurately receive and capture acoustic signals that occur in the environment around the microphone assembly 20.

The air flow F may be caused by wind that flows over the microphone assembly 20. The air flow F may also be caused by air that flows over the microphone assembly 20 when the microphone assembly 20 is attached to a vehicle and the vehicle is in motion. As can be appreciated, water or other contaminants that may be contained in the air flow F or moved with the air flow F are also minimized or prevented from entering the gap 40 and causing interference or damage to the microphone assembly 20. The recirculation zone Z minimizes or prevents water and other contaminants from entering the gap 40.

The height H of the gap 40 can be any suitable height to induce the air flow F to either recirculate in the recirculation zone Z or to flow over the gap 40 without causing a significant amount of the air flow F to pass through the gap 40. In addition, the height H of the gap 40 also reduces the incidence that the acoustic signal reflects between the downwardly-facing surface 36 of the cap 24 and the second surface 32 of the base 22. This reduction of reflection allows for acoustic waves to pass through the gap 40 rather than being reflected between the second surface 32 and the downwardly-facing surface 36 which increases the reliability and accuracy of the microphone assembly 20 in detecting and capturing a direction of the acoustic signal that enters the gap 40. Acoustically, a preferred height H of the gap 40 can be based on the speed of sound and the maximum frequency the microphone will use. In one example, a preferred height is calculated using the equation, $H<c/(2f)$, where c is the speed of sound and f is the maximum frequency the microphone will use.

In one example, the height H of the gap 40 is a vertical distance in the range of greater than or equal to about 3.5 mm to less than or equal to about 10 mm. In another example, the gap 40 is a vertical distance less than or equal to about 10 mm. In another example, the gap 40 is a vertical distance of less than one-third of a total height TH (FIGS. 3 and 4) of the microphone assembly 20. In still other examples, the height H is about 5 mm, about 6 mm, about 7 mm, about 8 mm, about 9 mm, or optionally about 10 mm.

In the example shown, the domed portion 28 of the cap 24 has a smooth rounded profile that is curved in a direction away from the base 22. The domed portion can have a convex shape that curves away from the second surface 32 of the base 22. The cap 24 is supported in its relative position to the base 22 by at least one support column. In the example shown in FIG. 1, the cap 24 is supported above the base 22 by a rear support column 44, a first forward support column 46 and a second forward support column 48. The rear support column 44 has a rounded fin-shaped profile. The rear support column 44 is positioned at a rear of the microphone assembly 20. The first forward support column 46 and the second forward support column 48 are cylindrical support members positioned forward of the rear support column 44. The rear support column 44, the first forward support column 46 and the second forward support column 48 are positioned toward an outer edge of the cap 24 so as to not interfere with the microphone array that is positioned inside the cap 24. In other examples of the microphone assembly 20, the cap 24 may be supported by more or fewer than the three support columns 44, 46, 48 shown in FIG. 1. For example, the cap 24 can be supported by only the rear support column 44 or by a single center support column (not shown).

The rear support column 44, in this example, includes a hollow channel. The hollow channel connects the cap 24 to the base 22. The hollow channel permits wires to be routed from the microphone array 60 (described further below) to one or more electrical components or to control modules that may process the signals received and captured by the microphone assembly 20. In other examples, one or more of the other support columns can include a hollow channel through which power cables, communication wires or other transmission conduits can be routed. In still other examples, wireless communication and/or power transmission components can be used.

Figure 5:
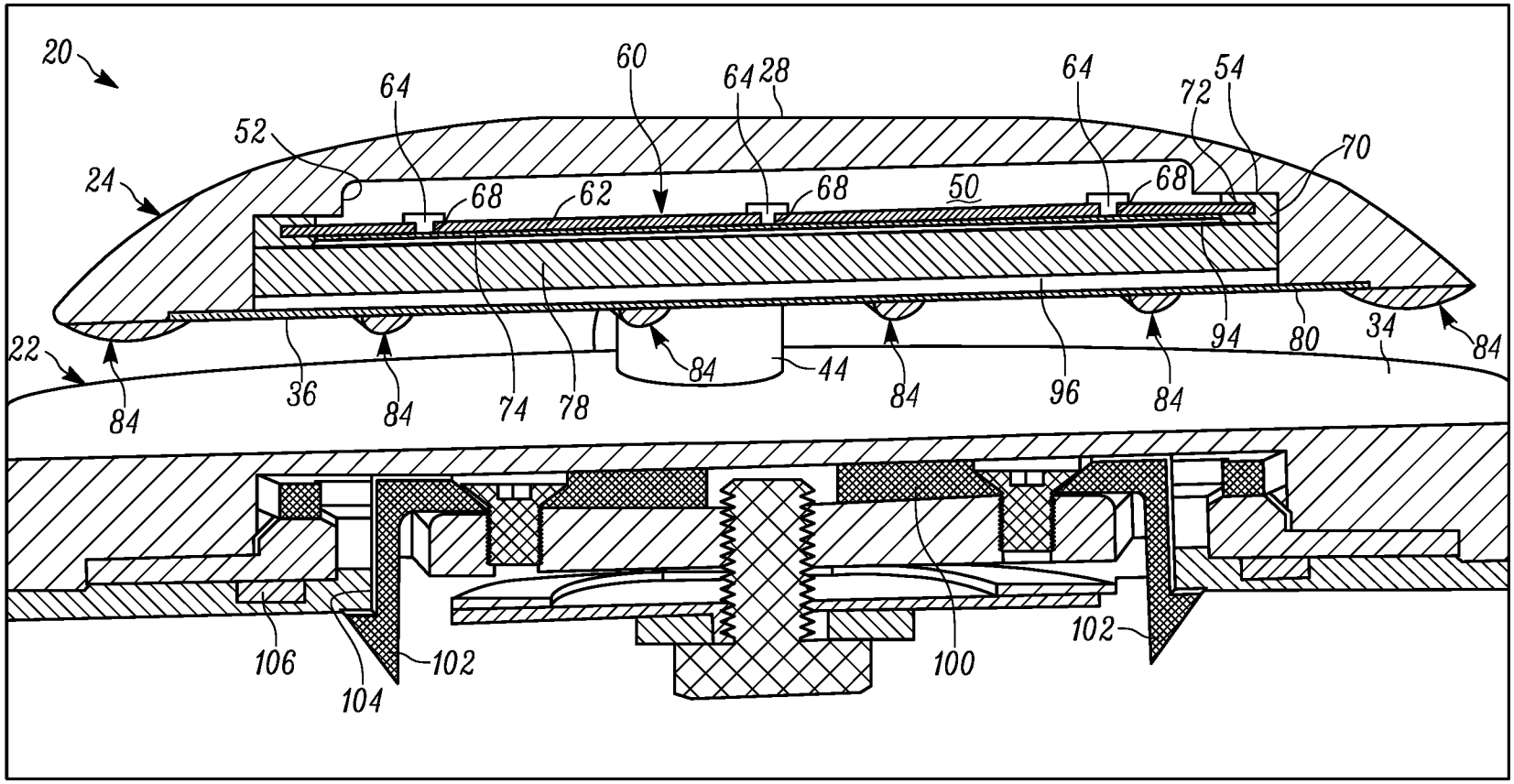
FIG. 5 is a sectional view of the microphone assembly of FIG. 1.

As shown in FIG. 5, the cap 24 may include a void 50 defined by a cap wall 52. The cap wall 52, in the example shown, projects into the cap 24 from the downwardly-facing surface 36. The void 50 defined by the cap wall 52 may be suitably sized to receive a microphone array 60 therein. The void 50 may have a round profile with a first shoulder portion 54. The microphone array 60 may be seated on the first shoulder portion 54 to retain the microphone array 60 inside the void 50.

Figure 7:
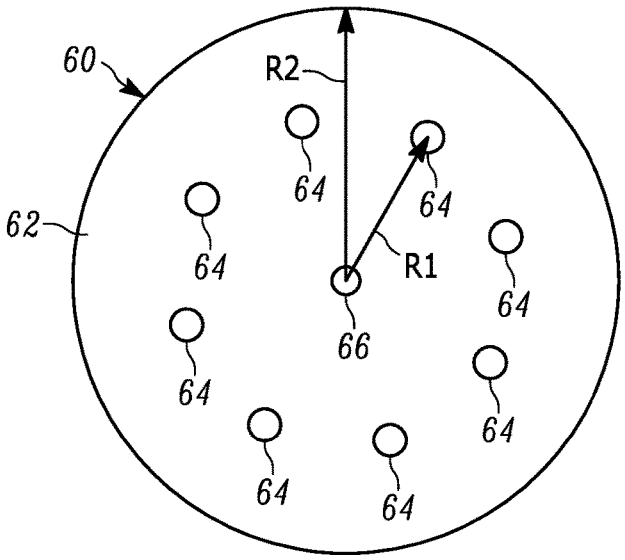
FIG. 7 is top view of an example microphone array used in the microphone assembly of FIG. 1.

The microphone array 60, as shown in FIGS. 5 and 7, may include a microphone substrate 62 and a plurality of microphones, here shown to be at least three microphones 64. The microphone substrate 62 can be any suitable material to support the microphones 64. In the example shown, the microphone substrate 62 is a printed circuit board (PCB). The microphones 64 are mounted to a side of the microphone substrate 62 facing an inner surface of the domed portion 28 of the cap 24. The microphones 64 may be any suitable microphone such as a microelectro-mechanical systems (MEMS) microphone or electret microphone.

The microphones 64 may be mounted to the microphone substrate 62 in any suitable pattern with acoustic beamforming capability. To achieve this functionality, in certain variations, the microphone array 60 includes at least three microphones 64. With at least three microphones 64, the microphone array 60 can identify a direction of a target acoustic signal that is received by the microphone array 60. In the example shown in FIGS. 5 and 7, the microphone array 60 includes nine microphones 64. The microphone array 60 can be arranged with a center microphone 66 positioned at or near a center of the microphone substrate 62. The eight surrounding microphones 64 are positioned in a circular pattern around the center microphone 66. The surrounding microphones 64 may be equally spaced peripherally (e.g., circumferentially) around the center microphone 66. In the example shown, the surrounding microphones 64 are positioned at circumferential positions 45 degrees from one another. The surrounding microphones 64 form a circular peripheral arrangement around the center microphone 66 with a radius R1. The surrounding microphones 64 may be positioned at any suitable radius from the center microphone 66. In one example, the surrounding microphones 64 are positioned at a radius of 20 mm from the center microphone 66. In other examples, the surrounding microphones are positioned at a radius R1 that is greater than one-half of an overall radius R2 of the microphone substrate 62. In still other examples, the surrounding microphones 64 can be positioned on the microphone substrate at other distances or in other patterns.

The microphones 64 may be mounted to the microphone substrate 62 at a series of apertures 68. In the example shown in FIG. 5, the microphones 64 are each mounted to the microphone substrate 62 over an aperture 68. As can be appreciated, the apertures 68 are positioned in the microphone substrate 62 in a pattern similar to the round array pattern previously described. As such, the microphone substrate 62 includes at least one aperture 68 for each of the microphones 64. With this arrangement, the acoustic signals that are received by the microphone array 60 travel into the gap 40 from the external environment and pass through the apertures 68 before being received by the microphones 64.

As further shown in FIG. 5, the microphone array 60 can be mounted in the void 50 of the cap 24 by a gasket 70. The gasket 70 can be made of a suitable elastomeric material such as a natural or synthetic rubber or other elastomeric polymer materials. The gasket 70 can include an internal groove 72. The microphone array 60 can be positioned inside the internal groove 72 of the gasket 70 so that a portion of the gasket 70 is located between the microphone array 60 and the first shoulder portion 54 of the cap 24. In this manner, the microphone array 60 is not directly connected to the cap 24 and can be isolated from vibrations that could otherwise be transferred from the cap 24 to the microphone array 60. The gasket 70 can provide vibration damping from the cap 24. Such isolation of the microphone array 60 can improve the performance of the microphone array 60.

As further shown in FIG. 5, the microphone array 60 may include a membrane 74 that is positioned over the lower surface of the microphone array 60. The membrane 74 can be a thin layer of a porous or semi-porous material that is semi-permeable or hydrophobic with respect to water or other environmental contaminants, so that the presence of the membrane 74 minimizes or prevents water or other contaminants from contacting the microphone array 60. The membrane 74 can be made of any suitable porous, semi-porous or hydrophobic material that prevents water or other liquids from passing through the material while permitting acoustic signals from the environment to pass through the membrane to the microphones 64. For example, the membrane 74 can be made of a porous or semi-porous hydrophobic material, such as silicone rubber, an expanded polytetrafluoroethylene (ePTFE), or the like.

In other examples of the microphone assembly 20, the membrane 74 may not extend across the lower surface of the microphone substrate 62. Alternatively, the membrane 74 can be positioned locally to cover each of the apertures 68. In such examples, the membrane 74 includes one or more membrane patches of the porous or semi-porous material to prevent the ingress of water or other contaminants.

The microphone assembly 20 may include other elements to further protect the microphone array 60 from water or other contaminants. In the example shown in FIG. 5, further layers of protection are disposed inside the void 50 of the cap 24. As shown, the microphone array 60 may include a foam layer 78 that is positioned inside the void 50 between the microphone array 60 and the downwardly-facing surface 36 of the cap 24. The foam layer 78, in the example shown, is a round disc of acoustic foam having desirable sound damping properties. In one example, the foam layer 78 is made of a suitable open-cell polyurethane foam. In other examples, other types of suitable foam can be used. The foam layer 78 can be fixed in a desired vertical position inside the void 50 using adhesive or other attachment.

The microphone assembly 20, in the example shown, also includes a scrim layer 80. The scrim layer 80 is layer of semi-permeable material that extends across the void 50 at the downwardly-facing surface 36 of the cap 24. The scrim layer 80 can be made of any suitable material that minimizes or prevents water from entering the void 50 and permits acoustic signals to pass through the material to the microphone array 60. The scrim layer 80 can be made of materials similar to the membrane 74. The scrim layer 80 can also be a multi-layer material to provide additional protection to the microphone array 60. For example, the scrim layer 80 can include a first layer of a polymer, such as nylon or polyester and a second layer of a distinct polymer, such as a hydrophobic material like expanded polytetrafluorothylene. The first layer can provide additional resistance to debris, particles or other materials that may contact the scrim layer 80. In other examples, the scrim layer 80 can include more than two layers of material to provide additional layers of protection.

Figure 6:
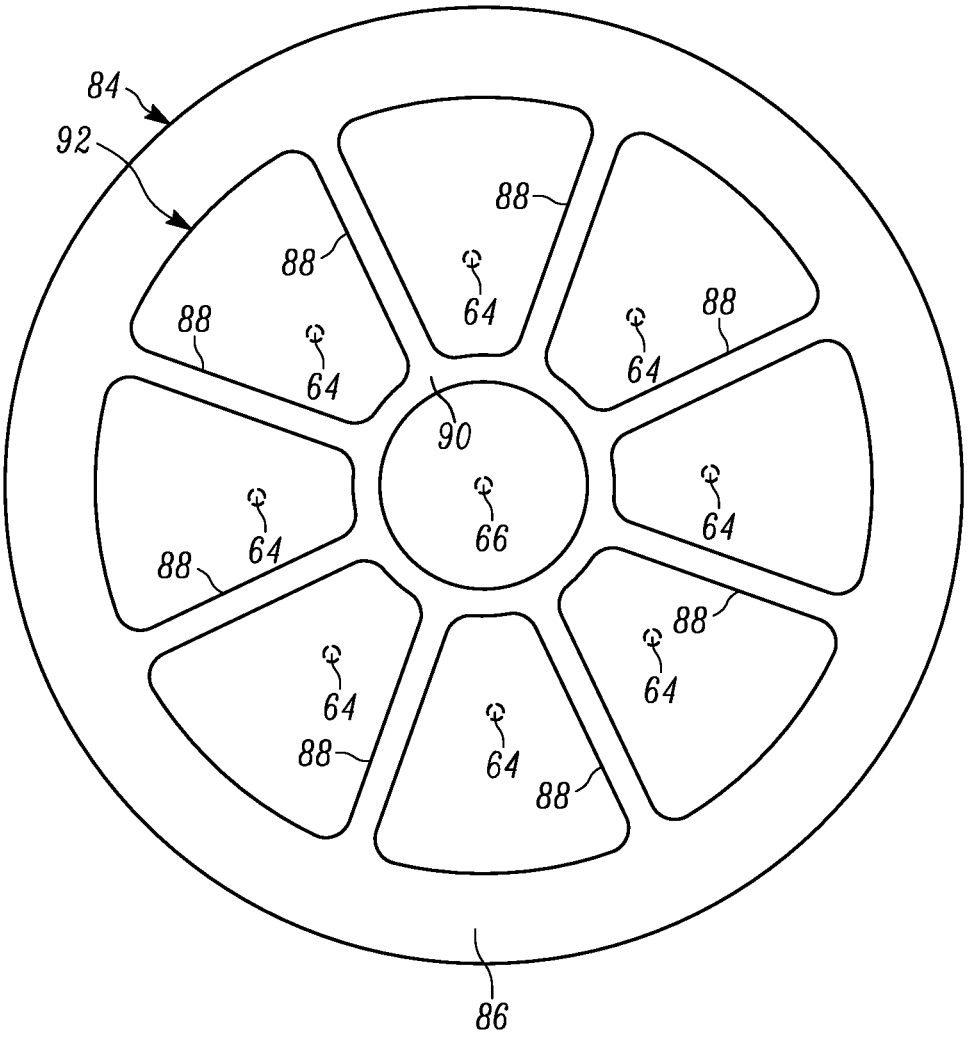
FIG. 6 is a bottom view of a cap of the microphone assembly of FIG. 1 showing a grill positioned over a microphone array.

The scrim layer 80 may be made of a fabric or textile material and can have a tendency to sag or otherwise fall into the gap 40 from the downwardly-facing surface 36 of the cap 24. To prevent the scrim layer 80 from sagging into the gap 40, the microphone assembly 20 may also include a grill 84 for support of the scrim layer 80. As shown in FIGS. 5 and 6, the grill 84 is positioned below the scrim layer 80 and can be connected to the cap 24 to fix the grill 84 in is position under the void 50. The grill 84 includes an outer ring 86 and one or more bars 88. The outer ring 86 is an annular member that follows an outer peripheral edge of the cap 24. The bars 88 are connected to the outer ring and are positioned to extend across the void 50. The grill 84 is made of suitable rigid material such that the grill 84 spans across the void 50 and can support the scrim layer 80 and/or the other protective layers of the microphone assembly 20 from sagging below the cap 24 and into the gap 40. In one example, the grill 84 is made of a suitable thermoplastic polymer material.

In the example shown in FIG. 6, the bars 88 extend radially inward from the outer ring 86 to an inner ring 90. The outer ring 86, the bars 88 and the inner ring 90 can define one or more openings through which the acoustic signals can pass from the gap 40 to the microphone array 60. In the configuration shown, the grill 84 defines an opening 92 for each of the microphones 64. The inner ring 90 defines an opening 92 for the center microphone 66. The bars 88, the outer ring 86 and the inner ring 90 define eight additional pie-shaped openings 92. In other examples, the bars 88 can have different shapes and profiles to define other size apertures such as a grid shape or a star-shape.

In an alternative arrangement, the grill 84 can be positioned on top of the scrim layer 80. In such an alternative, the scrim layer 80 is connected to the grill 84 using adhesive or other suitable attachment to create a smooth surface positioned in the gap 40. Such an alternative arrangement can minimize or prevent the generation of buffeting from the air flow F.

As described above, the multiple protective layers of the microphone assembly 20 (e.g., the membrane 74, the foam layer 78, the scrim layer 80 and/or the grill 84) can be positioned directly adjacent one another. In other examples, such as in the example shown in FIG. 5, the microphone assembly 20 can include one or more open pockets between one or more of the protective layers, which can contain air. For example, a first air pocket 94 can be positioned between a lower surface of the membrane 74 and the top surface of the foam layer 78. The first air pocket 94 can minimize or prevent water or other contaminants that may have entered the void 50 from wicking (or otherwise moving) from the foam layer 78 into the microphone array 60. Similarly, the microphone assembly 20 can also include a second air pocket 96 positioned between the lower surface of the foam layer 78 and the upper surface of the scrim layer 80. The second air pocket 96 can minimize or prevent water or other contaminants from wicking (or otherwise moving) from the scrim layer 80 into the foam layer 78.

In other examples, the various protective layers can be integrated into one another or be assembled into the cap 24 as separate elements. For example, the scrim layer 80 can be integrally formed with the foam layer 78. In such an example, the foam layer 78 is formed with a skin layer that acts as the scrim layer 80 previously described. The various protective layers can also be disposed at positions on or in the microphone assembly 20 other than in or on the cap 24. For example, one or more of the various protective layers can be included on or in the base 22. In one such alternate example, protective layers similar to the scrim layer 80 and/or the foam layer 78 are disposed on the second surface 32 within the gap 40. Such protective layers on the second surface 32 of the base 22 can absorb acoustic reflections and aid in having acoustic waves pass through the gap 40.

Referring back to FIG. 5, the base 22 can include a mounting bracket 100 that is connected to the base 22 using any suitable attachment method such as fasteners, adhesive, welding staking or the like. The mounting bracket 100 can include one or more barbs 102 that project away from the base 22. The barbs 102 can engage an opening 104 in the external panel 26 to retain the base 22 (and the microphone assembly 20) in the mounting location. The microphone assembly 20 can also include one or more water intrusion seals 106. The water intrusion seal 106 is optionally made of a suitable elastomeric material and can be positioned between the base 22 (and/or the mounting bracket 100) and the external panel 26 to prevent the intrusion of water through the opening 104. In other examples, the microphone assembly 20 can be mounted to the external panel 26 using other attachments such as fasteners, adhesive, welding, staking or the like.

Figure 8:
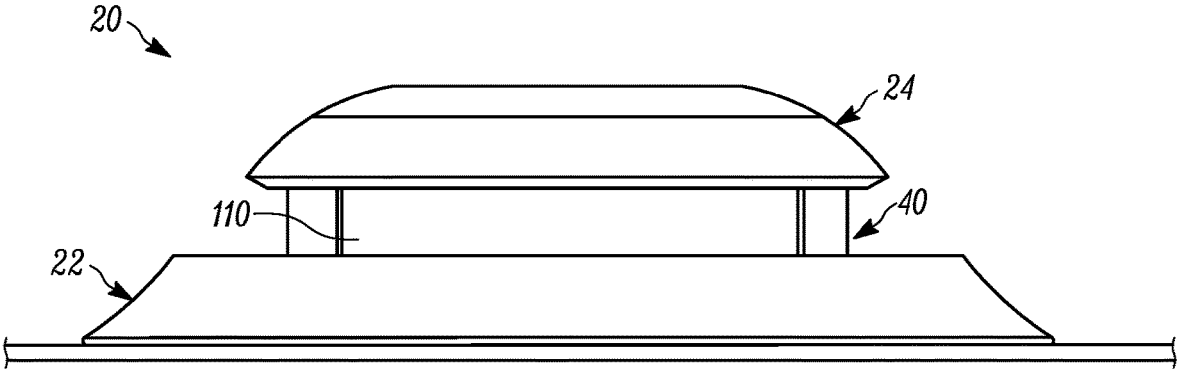
FIG. 8 is a side view of the microphone assembly of FIG. 1 showing an acoustic coupler inserted in the gap.
Figure 9:
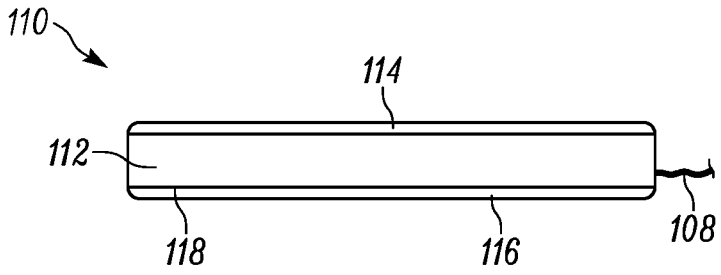
FIG. 9 is a side view of an example acoustic coupler of the present disclosure.
Figure 10:
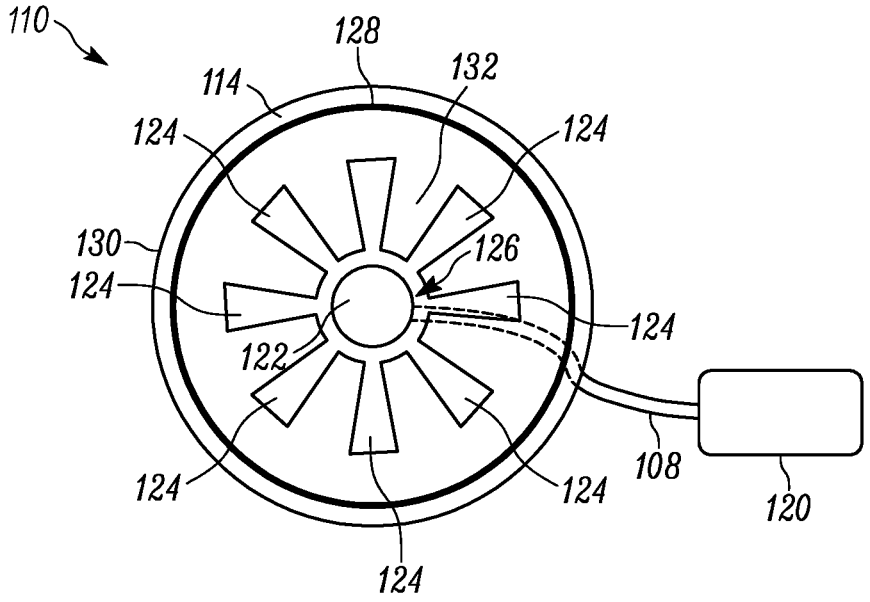
FIG. 10 is a top view of the acoustic coupler of FIG. 9.

Referring now to FIGS. 8-10, the microphone assembly 20 can also include an acoustic coupler 110. The acoustic coupler 110 can be inserted into the gap 40 between the base 22 and the cap 24. Once inserted into a seated position (as shown in FIG. 8), the acoustic coupler 110 can cause an identical acoustic pressure to be presented to each of the microphones 64 in the microphone array 60. As this occurs, the acoustic information collected from the microphones 64 can be used to calibrate the microphone assembly 20, validate the proper operation of the microphone assembly 20 and/or diagnose errors that are discovered during operation of the microphone assembly 20. To assist in this process, the acoustic coupler 110 can be electrically coupled to a signal generator 120 or other suitable processing device by the cable 108. The acoustic coupler 110 does not rely on acoustic wave propagation during operation. A microphone signal of each of the microphones 64 is measured after the acoustic coupler 110 is inserted into the microphone assembly 20. The microphone signal(s) are measured to obtain the frequency response of each microphone 64 and the phase relative to a reference signal. The reference signal can be a signal generated by the signal generator 120 or optionally can be a signal from one of the microphones 64 in the microphone array 60.

The acoustic coupler 110 can advantageously be inserted and used to calibrate, validate and/or diagnose issues associated with the microphone assembly 20 when the microphone assembly 20 is in an installed position on the external panel 26. The microphone assembly 20 does not need to be removed from the installed position.

The acoustic coupler 110 is sized proportionally to the size of the base 22, the size of the cap 24 and/or the size of the gap 40. The acoustic coupler 110 can be inserted into the gap 40 during use and removed from the gap 40 after such use is completed. In the example shown in FIGS. 8-10, the acoustic coupler 110 is shaped to match the shape of the downward-facing surface 36 of the cap 24. The acoustic coupler includes a body portion 112, a divider 114 and a biasing member 116. The body portion 112 includes the electronic components used to generate the acoustic pressures used during calibration, validation and/or diagnostics. The biasing member 116 is positioned on a lower surface 118 of the acoustic coupler 110. The biasing member 116 biases the divider 114 against downward-facing surface 36 of the cap 24 when the acoustic coupler 110 is inserted into the gap 40. The biasing member 116 can be any suitable structure that causes the body portion 112 and the divider 114 to be urged upwards toward the cap 24 when the acoustic coupler 110 is inserted into the gap 40. In the example shown, the biasing member 116 is layer of elastomeric foam. In other examples, the biasing member 116 can be a spring, wedge or other suitable feature.

As shown in FIG. 10, the acoustic coupler 110 includes an actuator 122. The divider 114 is positioned over the actuator 122 and divides the top of the acoustic coupler 110 into multiple actuation chambers 124. The divider 114, in the example shown, divides the top surface of the acoustic coupler 110 into nine separate actuation chambers 124. The divider 114 defines a center actuation chamber 126 and eight surrounding actuation chambers 124. These actuation chambers correspond to each of the microphones 64 previously described (see FIG. 7). In the example shown, the actuation chambers 124 include a round center actuation chamber 126 and wedge shaped surrounding actuation chambers 124 extending radially outward from the center actuation chamber 126.

The divider 114, in this example, is a round disc-shaped feature of the acoustic coupler 110 that is fixed to the top surface of the body portion 112 of the acoustic coupler 110. The divider 114 can include a ring portion 130 and a series of ribs 132 that extend radially inwardly from the ring portion 130 toward a center of the divider 114. In this manner, the ring portion 130 and the ribs 132 define the center actuation chamber 126 and each of the surrounding actuation chambers 124. The orientation, size and layout of the ring portion 130 and ribs 132 can be configured to break up or eliminate any undesirable acoustic modes by reducing the volume of the actuation chambers 124.

As further shown, the divider 114 can also include a seal 128 that is positioned on the outer portion 130. The seal 128 can be pressed against the grill 84 when the acoustic coupler 110 is inserted into the gap 40. The biasing member 116 can urge the acoustic coupler 110 into contact with the cap 24 and/or the grill 84 to ensure that an air-tight seal is maintained and air or sound is not permitted to escape during calibration, validation or diagnostics.

The actuator 122 is positioned at the center of the acoustic coupler 110 and in the center actuation chamber 126. The acoustic coupler 110 vibrates or otherwise moves to oscillate the air inside the center actuation chamber 126 and each of the surrounding actuation chambers 124 to identical pressure levels. In this manner, the acoustic coupler 110 can be used for calibration, validation and/or diagnostics of the microphone array 60. The actuator 122 can be any suitable driver that can oscillate the pressure levels inside the actuation chambers 124. For example, the actuator 122 can be loudspeaker or a piezoelectric crystal.

Figure 11:
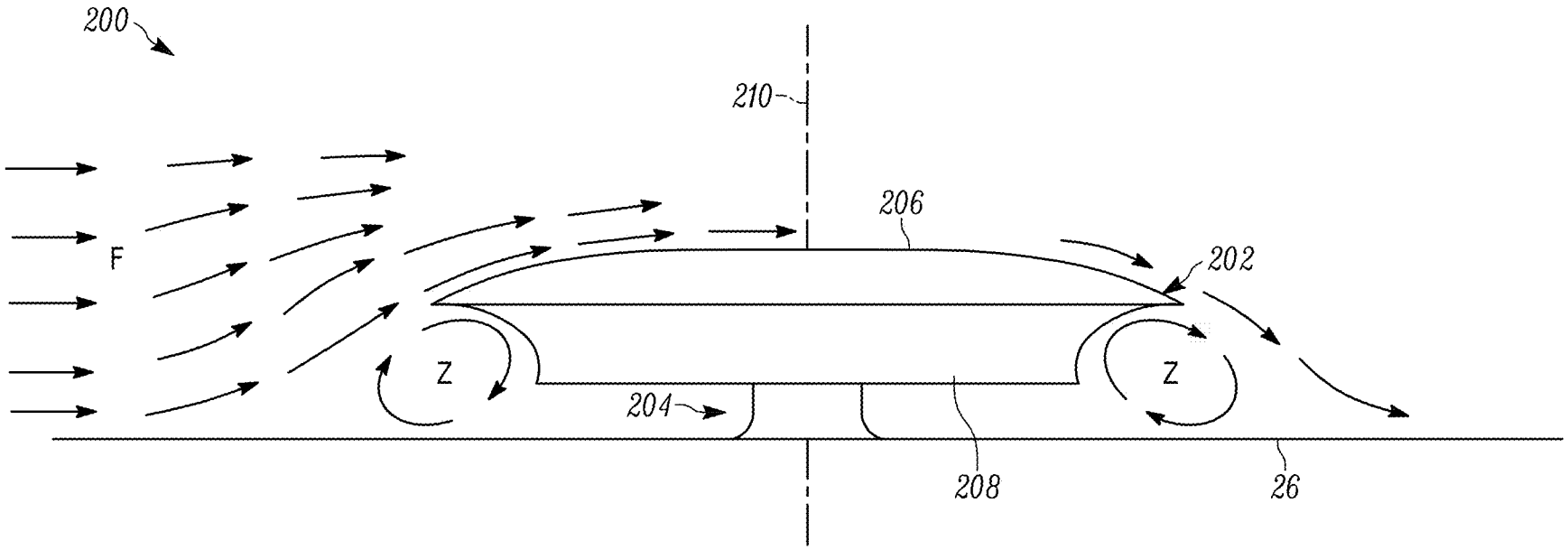
FIG. 11 is a side view of another example microphone assembly in accordance with the present disclosure.

Other examples of the microphone assembly of the present disclosure can have different shapes and profiles from that previously described. In another example shown in FIG. 11, a microphone assembly 200 includes a cap 202 supported above the external panel 26. The cap 202 is positioned above the external panel 26 by a gap 204. In this example, the cap 202 includes an upper portion 206 and a lower portion 208. The upper portion 206 has a rounded concave shape that curves outwardly with respect to a center axis 210. The lower portion 208 has a convex shape that curves inwardly toward the center axis 210. With this configuration, the air flow F is directed in a manner to flow over the upper portion 206 or caused to recirculate in the recirculation zone Z. In this manner, wind or air that flows over the microphone assembly 200 is minimized or prevented from flowing through the gap 204.

The microphone assembly 200, while not shown, can include the microphone array 60 and/or one or more of the protective layers (i.e., the membrane 74, the foam layer 78, the scrim layer 80 and/or the grill 84) in a void in the cap 202.

Figure 12:
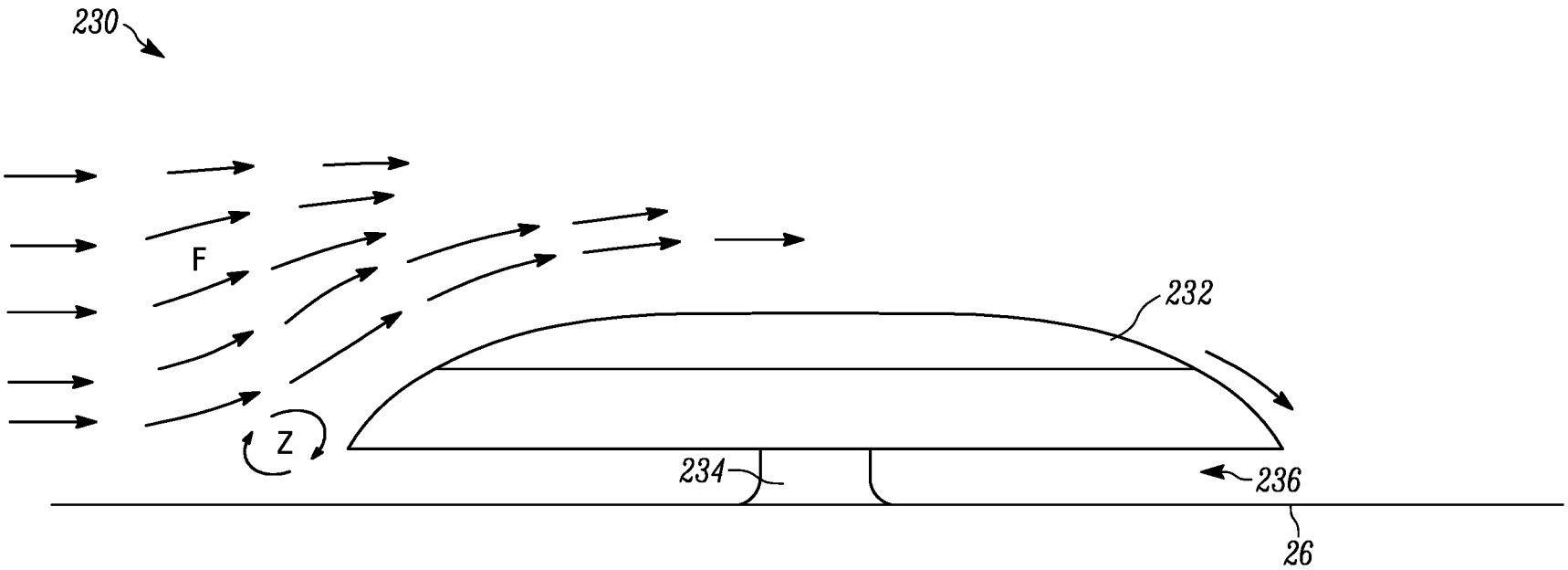
FIG. 12 is a side view of another example microphone assembly in accordance with the present disclosure.

In still another example as shown in FIG. 12, a microphone assembly 230 includes a cap 232 supported above the external panel 26 by a central support member 234. The cap 232, in this example, has a rounded shape and is supported above the external panel 26 by a gap 236. In this instance, the gap 236 has a height so as to minimize or prevent air from flowing under the cap 232. As shown, the air flow F that flows over the microphone assembly 230 either flows over the cap 232 or is recirculated in the recirculation zone Z. In such a configuration, air or wind is minimized or prevented from flowing under the cap 232 through the gap 236.

The microphone assembly 230, while not shown, can include the microphone array 60 and/or one or more of the protective layers (i.e., the membrane 74, the foam layer 78, the scrim layer 80 and/or the grill 84) in a void in the cap 232.

Figure 13:
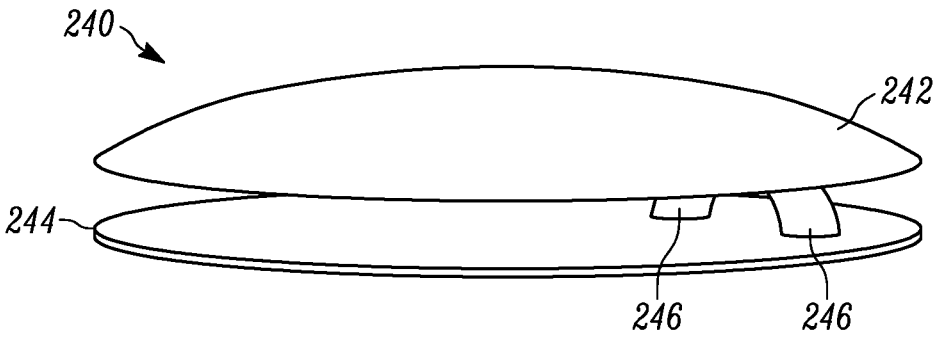
FIG. 13 is a perspective view of another example microphone assembly in accordance with the present disclosure.
Figure 14:
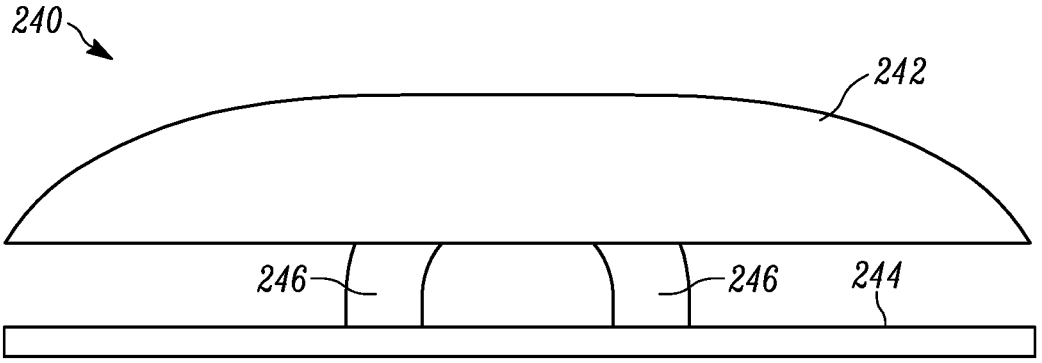
FIG. 14 is a rear view of the microphone assembly of FIG. 13.

In still another example as shown in FIGS. 13 and 14, a microphone assembly 240 can include a cap 242 supported above a base 244 by two curved support columns 246. In this example, the cap 242 includes a hemi-spherical shape in which the cap 242 curves upwardly away from the base 244. In another example, the cap 242 can be saucer-shaped. The base 244 can be connected to an external panel 26 to mount the microphone assembly in a mounting location. The microphone assembly 240, while not shown, can include the microphone array 60 and/or one or more of the protective layers (i.e., the membrane 74, the foam layer 78, the scrim layer 80 and/or the grill 84) in a void in the cap 242.

As previously described, the microphone assemblies of the present disclosure can be used on autonomous vehicles to detect acoustic signals such as sirens of emergency vehicles or other warning sounds external to the vehicle. The microphone assemblies can also be used to detect various other acoustic signals such as voice commands, pedestrian noises, surrounding vehicle sounds and the like. In addition, the microphone assemblies can also be used in other external applications other than on vehicles. Such alternate applications can include wind turbines, security applications, residential applications, personal electronics applications and others.

The microphone assemblies of the present disclosure have the capability to receive frequency, phase and signal-to-noise ratio information associated with external acoustic signals. Such information includes directional information for use in beamforming. The previously described structure of various example microphone assemblies, particularly including the height and orientation of the gap between the cap and the base, prevents external acoustic signals from reflecting within the microphone assembly to cause a loss of directionality or other important information associated with the acoustic signal. In addition, various aspects of the microphone assemblies minimize or prevent water, wind, wind buffeting, vibration, or other noise factors to reach the microphone arrays of the various example microphone assemblies.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A microphone assembly comprising:

a base including a first surface, a second surface and a third surface, the first surface configured to connect the base to a mounting location in an external environment, the second surface positioned parallel to the first surface with the third surface positioned therebetween, wherein the third surface defines an angled or curved shape to direct air flow that contacts the third surface in a direction away from the first surface;

a cap disposed over and separated from the base by a gap, the cap including a domed portion, the domed portion having a convex shape that curves away from the second surface of the base; and a microphone array including a plurality of microphones, the microphone array disposed within the cap and configured to receive acoustic signals from the external environment through the gap;

a scrim layer connected to the cap and positioned between the microphone array and the gap, the scrim layer configured to minimize or prevent water or other contaminants from contacting the microphone array;

a grill connected to the cap on a side of the scrim layer opposite to the microphone array, the grill including one or more openings configured to permit the acoustic signals to pass through the grill to the microphone array;

a membrane positioned between the microphone array and the scrim layer, the membrane configured to minimize or prevent water or other contaminants from contacting the microphone array;

a foam layer disposed between the membrane and the scrim layer and fixed relative to the cap; and a first pocket and a second pocket located inside the cap, the first pocket defined by a lower surface of the membrane and an upper surface of the foam layer, and the second pocket defined by a lower surface of the foam layer and an upper surface of the scrim layer.

2. The microphone assembly of claim 1, wherein the base has a round shape and the cap has a round shape, and wherein the cap has a first outer diameter and the second surface of the base has a second outer diameter, the first outer diameter being less than the second outer diameter, and the first outer diameter being inset from the second outer diameter.

3. The microphone assembly of claim 1, wherein the microphone array includes a center microphone and a plurality of surrounding microphones connected to a microphone substrate, the microphone substrate having a round shape and fixed inside the cap, the center microphone positioned at a center of the microphone substrate and the plurality of surrounding microphones positioned in a peripheral arrangement around the center microphone.

4. The microphone assembly of claim 1, wherein:

the microphone array includes a microphone substrate connected to the cap;

the plurality of microphones comprises at least three microphones; and the at least three microphones are mounted to a side of the microphone substrate facing an inner surface of the domed portion of the cap, the microphone substrate including at least one aperture to permit the acoustic signals to pass from the gap through the microphone substrate to the at least three microphones.

5. The microphone assembly of claim 4, wherein the at least one aperture comprises at least one aperture for each microphone of the at least three microphones.

6. The microphone assembly of claim 1, wherein a height of the gap defined between the cap and the base is in a range of greater than or equal to about 3.5 mm to less than or equal to about 10 mm.

7. The microphone assembly of claim 1, further comprising a gasket positioned between the microphone array and the cap, the gasket configured to isolate the microphone array from vibrations associated with the cap.

8. The microphone assembly of claim 1, further comprising at least one support column connecting the cap to the base, the support column having a hollow channel configured to hold one or more wires that extend from the microphone array to the base.

9. The microphone assembly of claim 1 further comprising an acoustic coupler including an actuator, the acoustic coupler configured to be removably positioned between the cap and the base to direct predetermined acoustic pressures to each microphone of the plurality of microphones of the microphone array for calibration, validation or diagnostics of the microphone array.

10. The microphone assembly of claim 9, wherein the acoustic coupler includes a divider with a ring portion and a plurality of ribs, the ring portion positioned on a periphery of the acoustic coupler and the plurality of ribs projecting radially inwardly from the ring portion.

11. The microphone assembly of claim 10, wherein the acoustic coupler includes a biasing member positioned on a side of the acoustic coupler opposite to the divider, the biasing member biasing the divider against the cap.

12. The microphone assembly of claim 11, wherein the actuator is a piezoelectric crystal positioned at or near a center of the acoustic coupler.

13. The microphone assembly of claim 1, wherein the second surface is concave with respect to a center axis of the microphone assembly.

14. A microphone assembly for connection to an external panel of an autonomous vehicle, the microphone assembly comprising:

a round base including a first surface, a second surface and a third surface, the first surface configured to connect the round base to a mounting location in an external environment, the mounting location being the external panel of the autonomous vehicle, the second surface positioned parallel to the first surface with the third surface positioned therebetween, wherein the third surface defines an angled or curved shape to direct air flow that contacts the third surface in a direction away from the first surface; a round cap disposed over and separated from the round base by a gap, the round cap being connected to the round base by at least one support member, the round cap including a base-facing surface and a domed portion, the base-facing surface of the round cap vertically spaced apart from the second surface of the round base to define the gap therebetween, the domed portion having a convex shape that curves away from the second surface of the round base; a microphone array positioned inside a void in the round cap, the microphone array includes a microphone substrate and a plurality of microphones, the plurality of microphones including at least three microphones, the at least three microphones connected to the microphone substrate on a side of the microphone substrate opposite to the gap, the microphone substrate defining at least one aperture, wherein the at least three microphones are configured to receive acoustic signals through the gap and the at least one aperture; a membrane comprising a porous or semi-porous material positioned over the at least one aperture of a gap-facing surface of the microphone substrate, the membrane configured to minimize or prevent water or other contaminants from contacting the microphone array at; a foam layer positioned adjacent the gap-facing surface of the microphone substrate and being fixed relative to the round cap, the foam layer configured to reduce wind buffeting and noise directed toward the at least three microphones; a scrim layer connected to the round cap, positioned between the microphone array and the gap, and adjacent the foam layer on the base-facing surface of the round cap to cover the void, the scrim layer configured to minimize or prevent water or other contaminants from contacting the microphone array, wherein the membrane is positioned between the microphone array and the scrim layer, and wherein the foam layer is disposed between the membrane and the scrim layer; a grill connected to the base-facing surface of the round cap adjacent the scrim layer and opposite the microphone array, the grill including a border positioned adjacent the peripheral edge of the round cap, a plurality of support bars extending inwardly from the border, and one or more openings configured to permit the acoustic signals to pass through the grill to the microphone array, the grill supporting the scrim layer, and a first pocket and a second pocket located inside the round cap, the first pocket defined by a lower surface of the membrane and an upper surface of the foam layer, and the second pocket defined by a lower surface of the foam layer and an upper surface of the scrim layer.

* * * * *